US006597320B2

(12) United States Patent
Maeda et al.

(10) Patent No.: US 6,597,320 B2
(45) Date of Patent: Jul. 22, 2003

(54) ANTENNA FOR PORTABLE RADIO COMMUNICATION DEVICE AND METHOD OF TRANSMITTING RADIO SIGNAL

(75) Inventors: Noboru Maeda, Chiryu (JP); Shinji Ohoka, Nishio (JP); Goro Inoue, Obu (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 09/946,562

(22) Filed: Sep. 6, 2001

(65) Prior Publication Data

US 2002/0030630 A1 Mar. 14, 2002

(30) Foreign Application Priority Data

Sep. 11, 2000 (JP) ..... 2000-275402

(51) Int. Cl.[7] ..... H01Q 1/12; H01Q 1/24

(52) U.S. Cl. ..... 343/718; 343/702; 343/867

(58) Field of Search ..... 343/718, 702, 343/767, 866, 741; H01Q 1/12, 1/24

(56) References Cited

U.S. PATENT DOCUMENTS 5,541,610 A * 7/1996 Imanishi et al. ..... 343/702
6,124,831 A * 9/2000 Rutkowski et al. .. 343/700 MS
6,271,803 B1 * 8/2001 Watanabe et al. ..... 343/702
6,320,545 B1 * 11/2001 Nagumo et al. ..... 343/700 MS
2001/0052877 A1 * 12/2001 Honda et al. ..... 343/702

FOREIGN PATENT DOCUMENTS

| | | |
|---|---|---|
| JP | A-5-317278 | 12/1993 |
| JP | A-8-330826 | 12/1996 |
| JP | A-10-84215 | 3/1998 |
| JP | A-11-163757 | 6/1999 |

* cited by examiner

*Primary Examiner*—Hoanganh Le
(74) *Attorney, Agent, or Firm*—Posz & Bethards, PLC

(57) ABSTRACT

An antenna for a portable radio communication device is constructed with a conductive shield plate provided in a casing made of resin and shaped to be worn on a human body. The shield plate is capacitively coupled with a part of the human body to operate as an antenna element. A conductive cover of a battery is disposed in the casing to operate as the other antenna element. The antenna elements thus form an electric field-type dipole antenna. The conductive cover of the battery may also be capacitively coupled with the other part of the human body, so that the antenna operate as a loop antenna which uses the human body. The electric field-type antenna may be combined with a magnetic field-type antenna to make the directivity of the antenna to be isotropic.

12 Claims, 6 Drawing Sheets

ANTENNA FOR PORTABLE RADIO COMMUNICATION DEVICE AND METHOD OF TRANSMITTING RADIO SIGNAL

CROSS REFERENCE TO RELATED APPLICATION

This application is based on and incorporates herein by reference Japanese Patent Application No. 2000-275402 filed Sep. 11, 2000.

BACKGROUND OF THE INVENTION

The present invention relates to an antenna for a portable radio communication device and a method of transmitting a radio signal using such an antenna. This antenna and method may be used for radio-transmitting biomedical signals such as human pulse waves or lock/unlock control signals in a vehicle keyless entry system.

Conventional portable radio communication devices use rod antennas or loop antennas for radio signal transmission. If these antennas are built in the portable radio communication devices, the antenna efficiency is limited due to limitation in size of casings of the transmitters.

JP-A-11-163757 proposes to use a metal cover for a built-in battery of a radio communication device and use the metal cover as an antenna. This arrangement enables size reduction of the radio communication device without lessening antenna efficiency. It is however still likely that the antenna efficiency is limited due to limitation of size of the radio communication device, because the battery is built in the radio communication device.

SUMMARY OF THE INVENTION

It is therefore an object of the present invention to provide an antenna for a portable radio communication device and a method of transmitting a radio signal with an improved antenna performance.

It is a further object of the present invention to provide an antenna for a portable radio communication device, which is wearable on a human body or holdable by a human body and uses the human body as a part of the antenna for improving an antenna gain.

According to the present invention, an antenna is provided for a portable radio communication device, which has a built-in battery and a transmission circuit in a resin-made casing. The transmitter circuit is connected to a conductive member in the casing. The conductive member may be a cover of the battery or a plate. The conductive member is disposed to be capacitively coupled with a part of a human body through the casing when the casing is attached to the human body, so that an antenna element of an electric field-type antenna is formed to transmit output signals of the transmitter circuit.

Preferably, a magnetic field-type antenna is provided in the casing and combined with the electric field-type antenna to make the directivity of radiation to be isotropic.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

First Embodiment

Figure 1:
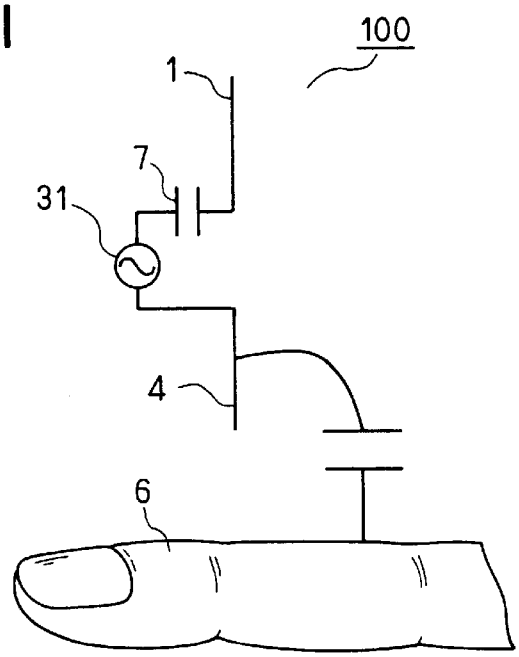
FIG. 1 is a model diagram of an antenna for a portable radio communication device according to a first embodiment of the present invention.
Figure 2:
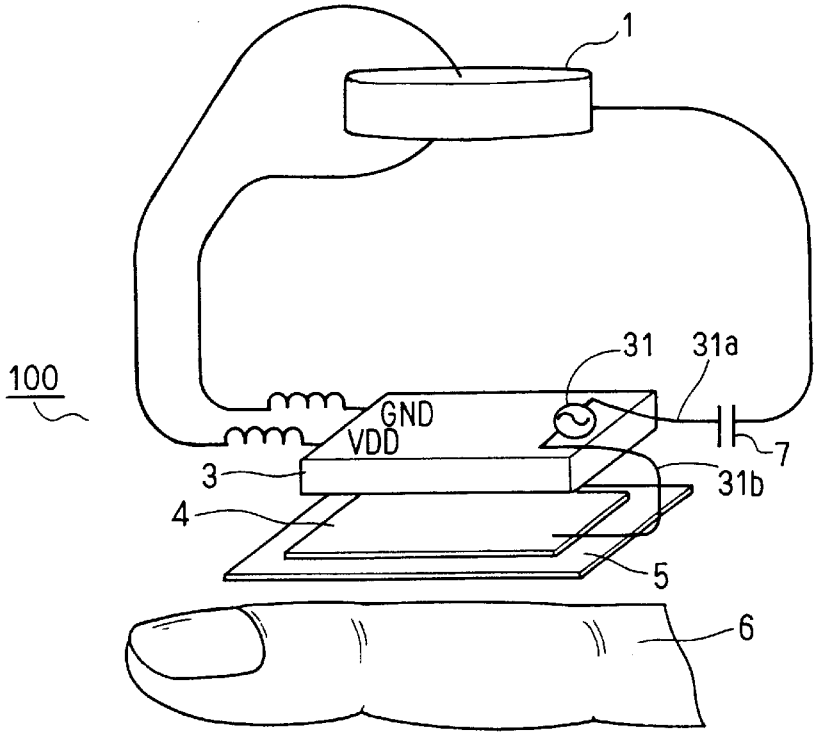
FIG. 2 is a schematic view of the antenna mounted in the portable radio communication device in the first embodiment.

In a first embodiment, as shown in FIGS. 1 and 2, a portable radio communication device 100 is constructed as a finger ring-type radio transmitter to be worn on a finger 6 of a human through a ring (not shown). The ring has a light emitter and a light receiver to detect variations in the amount of blood flow in the blood vessel as the pulse wave by the use of light absorbing property of hemoglobin in the blood and transmit detection data to a data analyzing system (not shown).

The portable radio communication device 100 has a transmitter circuit 31 formed on a circuit plate 3. The transmitter circuit 31 has an oscillator circuit. A battery 1 is mounted above the circuit plate 3 for supplying electric power to the transmitter circuit 31 and the like. A cover of the battery 1 is made of a metal and connected as one electrode member of an antenna to either the positive-side electrode or the negative-side electrode.

A shield plate 4 is provided under the circuit plate 3. The shield plate 4 is made of a conductive material (for instance, copper foil) to restrict erroneous operation of electronic circuits provided on the circuit plate 3 due to induction of external electric noises to the circuits of the circuit plate 3. The shield plate 4 is used as another electrode member of the antenna. The battery 1, the circuit plate 3 and the shield plate 4 are mounted within a casing made of a resin material, particularly on a resin-made bottom plate 5 of the casing.

The bottom plate 5 thus is interposed between the shield plate 4 and the finger 6, when the portable communication device 100 is worn on the finger 6.

The cover of the battery 1 is connected to one output terminal 31*a* of the transmitter circuit 31 formed on the circuit plate 3 through a capacitor 7. Thus, the cover of the battery 1 is used as one element of a dipole antenna. The capacitor 7 operates as a part of an impedance matching circuit for matching impedance between the transmitter circuit 31 and the antenna. The capacitor 7 also limits a direct current voltage of the battery from being applied to the output terminal 31*a* of the transmitter circuit 31. The other output terminal 31*b* of the transmitter circuit 31 is connected to the shield plate 4. Since the shield plate 4 faces the finger 6 through the bottom plate 5 of the casing, the shield plate 4 and the finger 6 are coupled capacitively, so that the shield plate 4 and the finger 6 operate as the other element of the dipole antenna.

For capacitive coupling between the shield plate 4 and the finger 6, the bottom plate 5 is preferably made of a resin material having a large permittivity (dielectric constant) and a small dielectric loss. For instance, the bottom plate 5 may be made of ABS resin having relative permittivity (relative dielectric constant) of 2.5 or epoxy resin having relative permittivity of 5.0. Epoxy resin is preferred because it has a higher relative permittivity. The shield plate 4 is held in direct contact with the bottom plate 5 to face the finger only through the bottom plate 5. Thus, the capacitive coupling between the shield plate 4 and the finger 6 can be increased.

In a simplified short distance communication, radio signal in 300 MHz band is often used. In this instance, if a radio signal transmitter is sized as small as a finger ring, the size of antenna is too small relative to a wavelength of 1 m and hence sufficient antenna efficiency cannot be provided. However, the radio communication device according to the above embodiment uses a part of human body as a part of its antenna, thus improving the antenna efficiency.

Antennas are categorized in an electric field-type antenna which directly generates electric field and a magnetic field-type antenna which directly generates magnetic field. If the magnetic field-type antenna is constructed by using a part of human body as an antenna element, it is necessary to flow electric current in the human body in a loop. To avoid this, the antenna of the first embodiment is constructed as the electric field-type antenna while using a part of human body as the antenna element.

In the case of a finger ring-type portable radio communication device, if the antenna is constructed as a mono-pole antenna, antenna efficiency is remarkably lowered because it is difficult to provide a grounding plate which defines the ground potential relative to the mono-pole antenna. Therefore, the antenna in the first embodiment is constructed as the electric field-type dipole antenna by using the metal cover of the battery 1 as one antenna element and the shield plate 4 and the finger 6 as the other antenna element.

In the case of using a part of human body as an antenna element, the part of human body cannot be used efficiently as an antenna element when the electrode and the human body are connected directly, because skin has a large contact resistance and contact condition varies. Accordingly, in the first embodiment, the shield plate 4 and the finger 6 are capacitively coupled via the bottom plate 5. As a result, a part of human body can be used effectively as an antenna element. Thus, antenna efficiency and antenna gain can be improved by using the radio communication device in contact with the human body.

Second Embodiment

Figure 3:
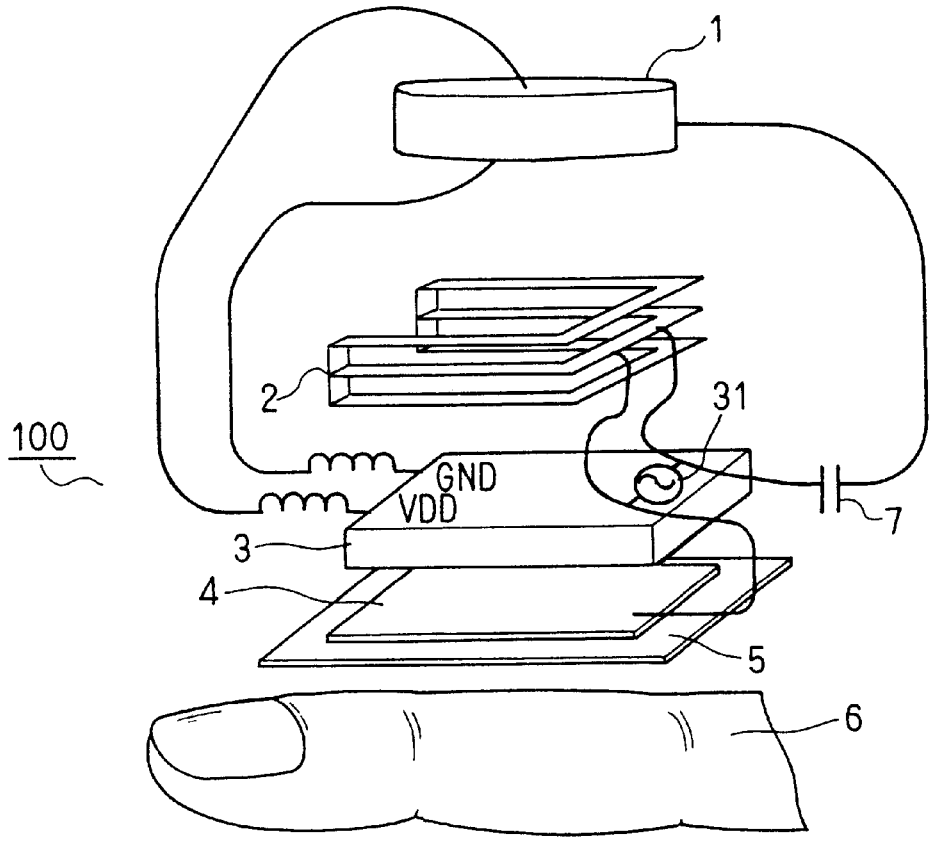
FIG. 3 is a schematic view of an antenna mounted in a portable radio communication device according to a second embodiment of the present invention.

In a second embodiment, as shown in FIG. 3, a center-fed loop antenna 2 is provided in addition to the dipole antenna in the first embodiment which is constructed with the battery 1, shield plate 4 and the finger 6. The loop antenna 2 is constructed three-dimensionally and connected to the transmitter circuit 31. Thus, the loop antenna 2 is combined with the dipole antenna. The loop antenna 2 is a magnetic field-type which directly generates magnetic field and has a radiation pattern different from that of the electric field-type dipole antenna. As two types of antennas are combined in the second embodiment, the directivity of radiation of the antenna can be made more isotropic.

Third Embodiment

Figure 4:
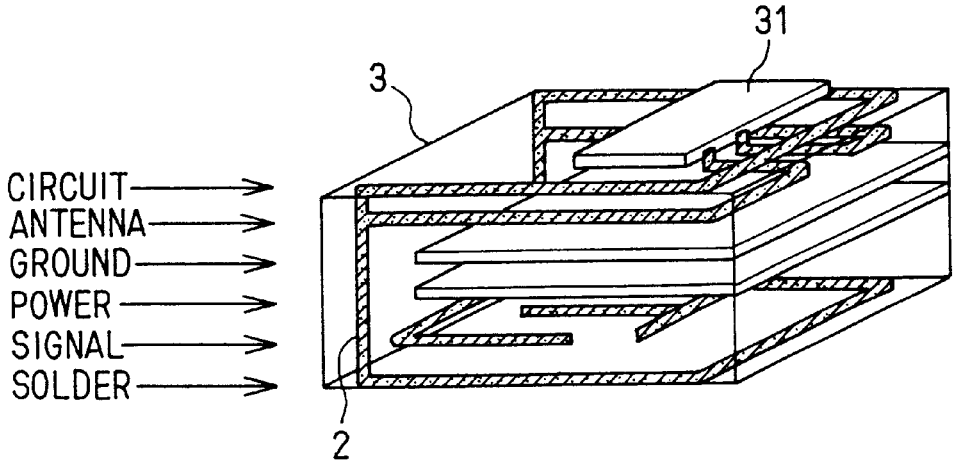
FIG. 4 is a schematic view of an antenna for a portable radio communication device according to a third embodiment of the present invention.

In a third embodiment, as shown in FIG. 4, the center-fed loop antenna 2 is provided and combined with the dipole antenna in the similar manner as in the second embodiment. However, the loop antenna 2 is integrated within the circuit plate 3.

Figure 13:
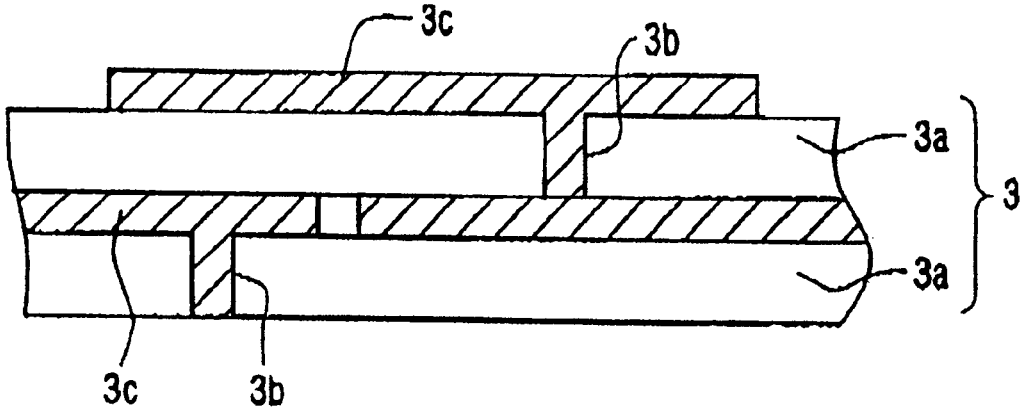
FIG. 13 is a partially schematic view of the circuit plate according to an alternative implementation of the third embodiment.

The circuit plate 3 is formed as a multi-layered (six-layered) plate. The loop antenna 2 is formed by forming conductive patterns on the first layer (circuit layer), second layer (antenna layer) and sixth layer (solder layer). The transmitter circuit 31 is connected to the conductive pattern of the second layer to receive a high frequency signal. The conductive pattern of each layer is connected through conductive patterns formed on the side surface of the multi-layered plate. The conductive patterns may all be formed on the side surface of the multi-layered plate. Alternatively, as shown in FIG. 13, the conductive patterns 3*c* may all be formed on the front surfaces of the layers 3*a* and connected by using through holes 3*b* formed in the circuit plate 3.

Figure 5:
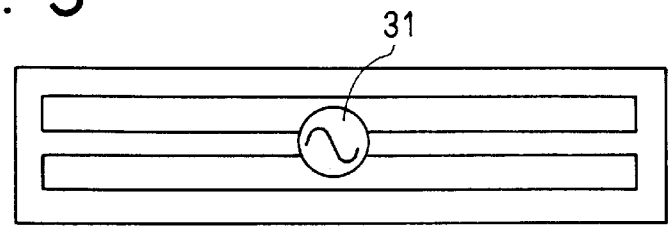
FIG. 5 is a schematic view of a combined antenna used in the third embodiment and shown in plane.

The loop antenna 2 shown in FIG. 4 is shown in FIG. 5 in a two-dimensionally (planarly) expanded form. By constructing the loop antenna 2 three-dimensionally, the loop antenna 2 can be sized larger than constructed two-dimensionally within the casing. As a result, the portable radio communication device can be sized small and the antenna efficiency can be improved.

Figure 6:
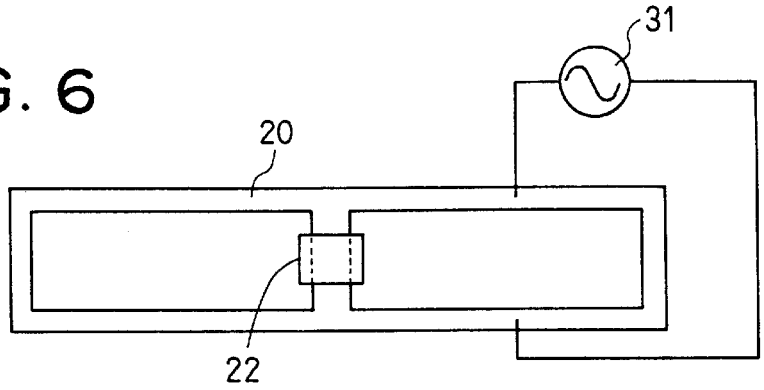
FIG. 6 is a schematic view of a slot antenna used as a modification of the third embodiment.

In the second and third embodiments, the loop antenna 2 combined with the dipole antenna of the first embodiment may be replaced with a slot antenna 20 which is also a magnetic-field type antenna. This slot antenna 20 is shown in FIG. 6 in a two-dimensionally expanded form. A matching capacitor 22 is provided in the slot antenna 31. The transmitter circuit 31 is connected to a part which is deviated from the center to the right side in FIG. 6, so that power is supplied from the transmitter circuit 31 to the impedance matching points of the antenna (offset fed). Combination of the dipole antenna and the slot antenna 20 is effective to make the directivity of radiation of the antenna to be isotropic.

Fourth Embodiment

Figure 7:
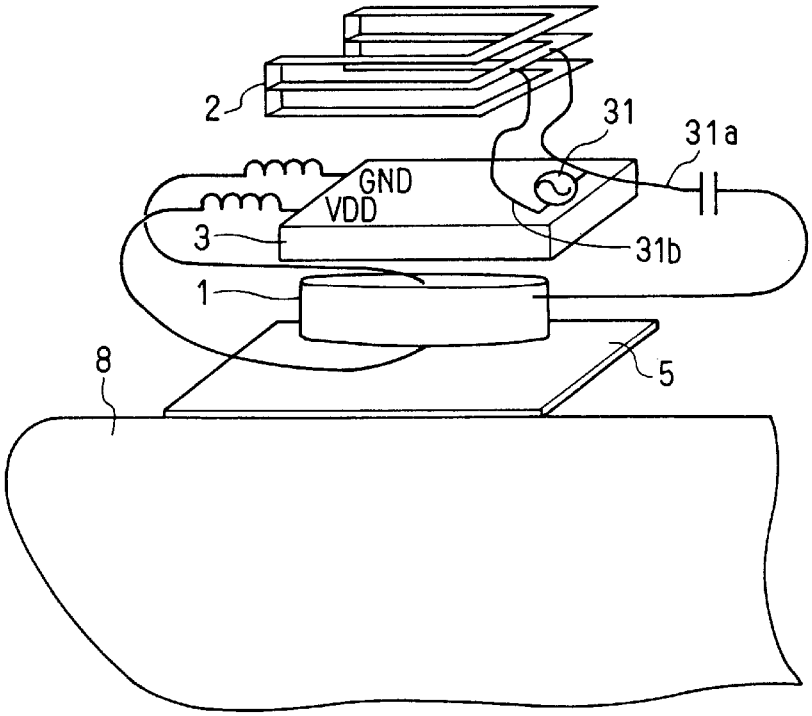
FIG. 7 is a schematic view of an antenna for a portable radio communication device according to a fourth embodiment of the present invention.

In a fourth embodiment, as shown in FIG. 7, the radio communication device is constructed in a wrist watch-type device to be worn around an arm or wrist of a human body. The battery 1 is disposed underside the circuit plate 3 in the casing. One terminal 31*a* of the transmitter circuit 31 is connected to the battery 1 so that the cover of the battery 1 is capacitively coupled with the arm 8 through the bottom plate 5 of the casing. The other output terminal 31*b* of the transmitter circuit 31 is connected as one dipole antenna element to a ground pattern (GND, not shown) of the circuit plate 3. Thus, the capacitive coupling can be made by the use of the battery without using a shield plate.

Fifth Embodiment

Figure 8:
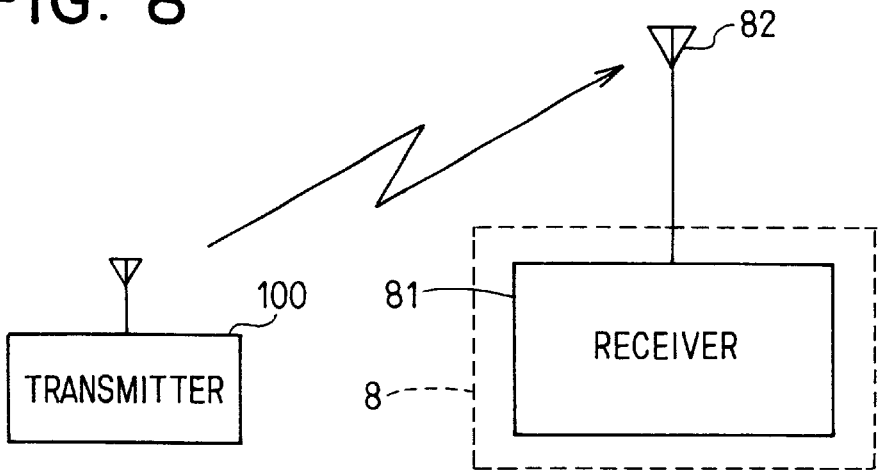
FIG. 8 is a schematic view showing a vehicle keyless entry system, which uses an antenna for a portable radio communication device according to a fifth embodiment of the present invention.

In a fifth embodiment, as shown in FIG. 8 the portable communication device 100 is constructed as a radio signal transmitter for transmitting a door lock/unlock control signal to a radio signal receiver 8 of a vehicle keyless entry system mounted in a vehicle. The radio signal receiver 8 includes a receiver circuit 81 and an antenna 82.

Figure 9:
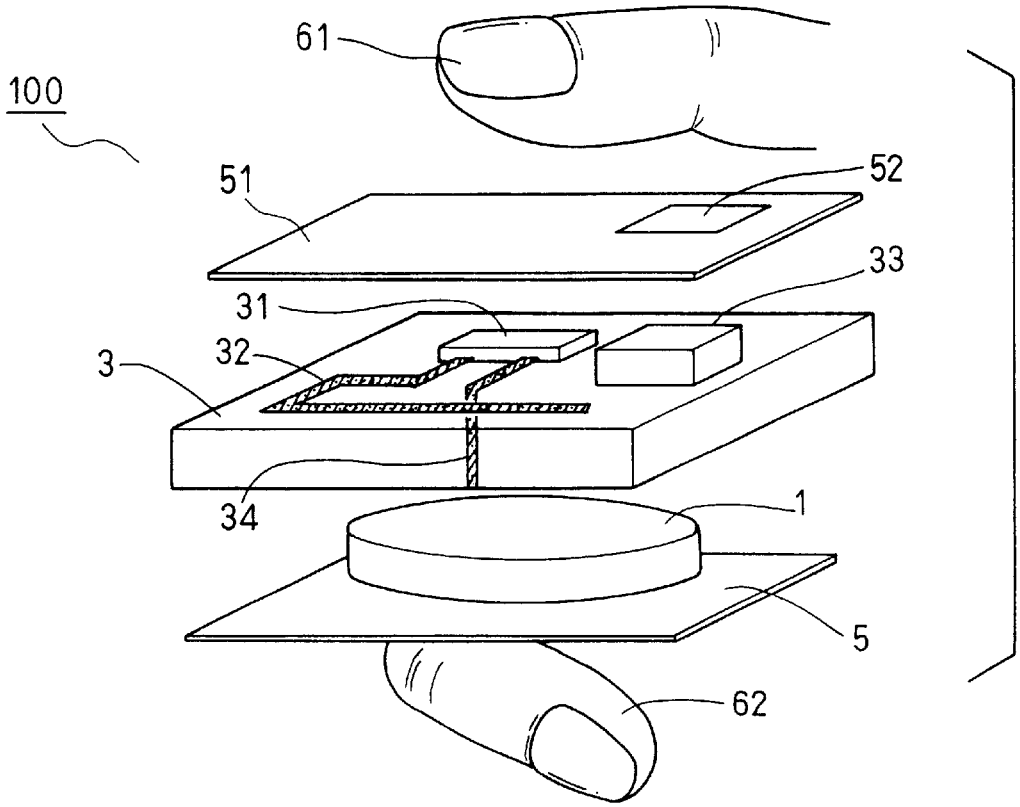
FIG. 9 is a schematic view of the antenna for a portable radio communication device according to the fifth embodiment.

In the portable radio communication device 100, as shown in FIG. 9, the transmitter circuit 31 is formed on the circuit plate 3. The battery 1 is mounted underside the circuit plate 3 in direct contact with the bottom plate 5 of the casing. The battery 1 is electrically connected with the transmitter circuit 31 for supplying electric power to the transmitter circuit 31. An antenna 32 is formed on the circuit plate 3 by patterning a conductive strip. The antenna 32 is connected to the transmitter circuit 31 to operate as one element of a dipole antenna. The cover of the battery 1 is connected to the transmitter circuit 31 through a conductor 34.

Further, a switch 33 is provided on the circuit plate 3 and connected to the transmitter circuit 31. The switch 33 is exposed outside through an opening 52 of a top plate 51 of the casing, so that it may be manipulated by the thumb 61 of a vehicle user. The top plate 51 is made of a resin material. The switch 33 may include two push buttons which are manipulated for instructing opening and closing of vehicle door, respectively. The transmitter circuit 31 generates the lock/unlock control signal when the switch 33 is operated by the vehicle user.

The radio communication device 100 is held by a hand of the vehicle user with the bottom plate 5 being held on the forefinger 62 and the top plate 51 being held underside the thumb 61. When the switch 33 is operated by the thumb 61, the bottom plate 5 is held in direct contact with the forefinger 62. The forefinger 62 and the cover of the battery 1 faces each other only through the bottom plate 5. The cover of the battery 1 and the forefinger 62 are capacitively coupled when the transmitter circuit 31 applies its output signal to the cover of the battery 1. Thus, the cover of the battery 1 and a part of human body operate as the other element of the dipole antenna when the lock/unlock control signal of the transmitter circuit 31 is transmitted.

Sixth Embodiment

Figure 10:
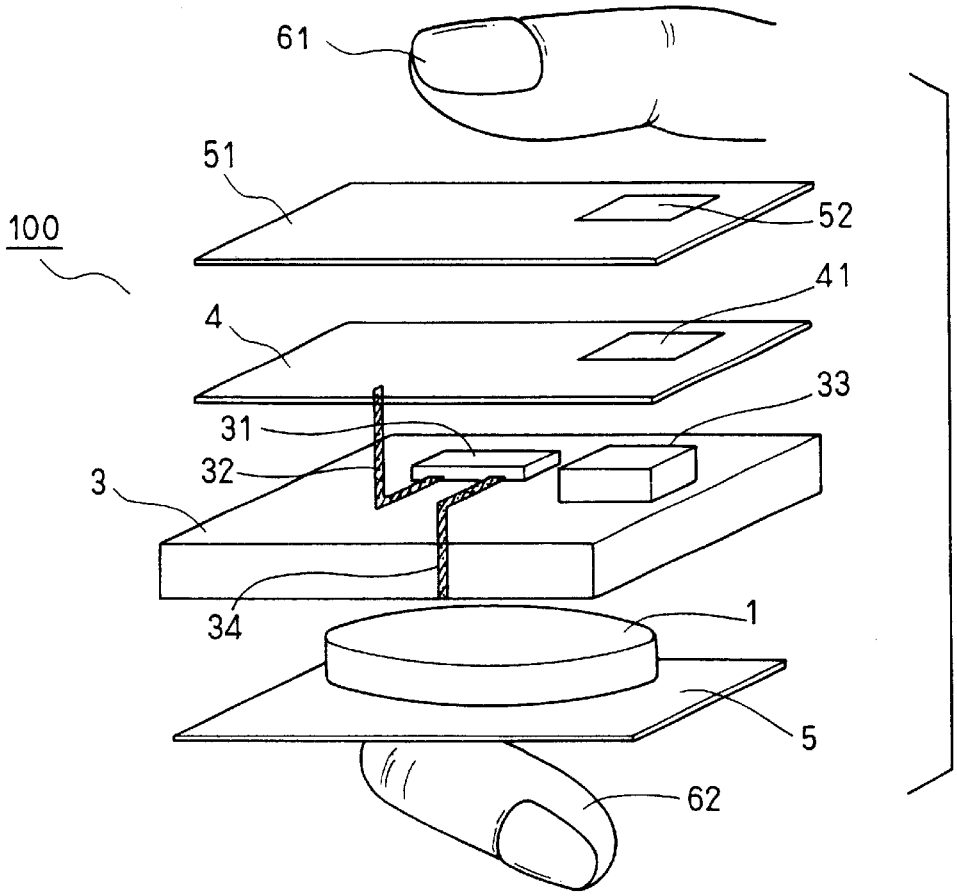
FIG. 10 is a schematic view of an antenna for a portable radio communication device according to a sixth embodiment of the present invention.
Figure 11:
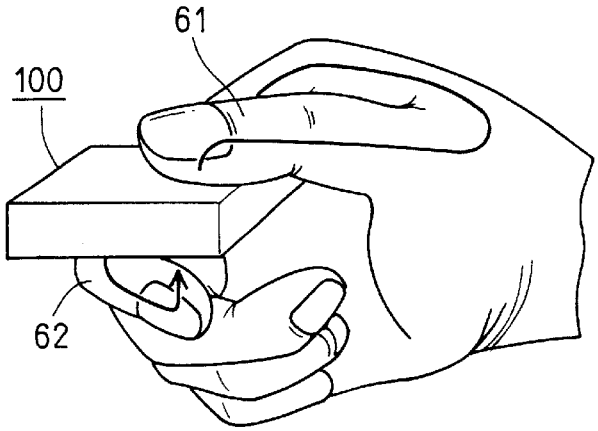
FIG. 11 is a schematic view of a loop antenna formed in the sixth embodiment.
Figure 12:
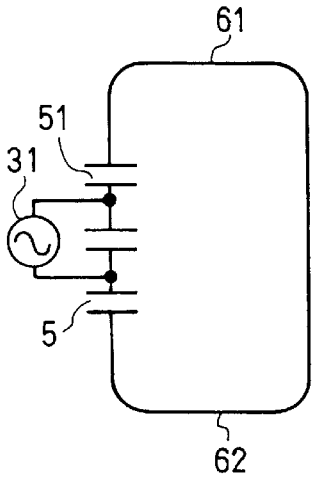
FIG. 12 is an equivalent circuit diagram of the loop antenna shown in FIG. 11.

In a sixth embodiment, as shown in FIGS. 10 to 12, the radio communication device 100 is constructed as a radio signal transmitter for a vehicle keyless entry system as in the fifth embodiment. In the sixth embodiment, however, a loop antenna is formed by capacitively coupling a pair of electrodes with different parts of a human body.

As shown in FIG. 10, the shield plate 4 made of a conductive metal is provided above the circuit plate 3 and underside the top plate 51 of the casing. The shield plate 4 has an opening 41 to allow the switch 33 to be exposed outside the top plate 52 and operated with the thumb 61. Two output terminals of the transmitter circuit 31 are connected to the shield plate 4 and the cover of the battery 1 through the conductors 32 and 34, respectively.

In operation, the radio communication device 100 is held as shown in FIG. 11 with the top plate 51 being in direct contact with the thumb 61 and the bottom plate 5 being in direct contact with the forefinger 62. The shield plate 4 and the cover of the battery 1 face the thumb 61 and the forefinger 62 only through the top plate 51 and the bottom plate 5 of the casing, respectively. Thus, when the transmitter circuit 31 applies the output signal for controlling lock/unlock of vehicle doors to the shield plate 4 and the cover of the battery 1, the shield plate 4 and the thumb 61 are capacitively coupled and the cover of the battery 1 and the forefinger 62 are capacitively coupled.

As a result, a loop antenna is formed as shown in FIG. 11 through the thumb 61 and the forefinger 62. Specifically, the output signal flows from the transmitter circuit 31 to the transmitter circuit 31 through the conductor 32, shield plate 4, thumb 61, forefinger 62, the cover of battery 1 and conductor 34.

According to the sixth embodiment, a part of the human body (thumb 61 and forefinger 62) are used to form a loop antenna. In this instance, the human body does not interrupt the electric field or the magnetic field generated by an antenna as opposed to the case where an antenna is provided within the casing of the radio communication device 100. This radio communication device 100 is therefore advantageous to be used while being carried by a human.

The present invention should not be limited to the disclosed embodiments, but may be modified in various ways. For instance, the loop antenna or slot antenna used in the second and third embodiments may also be combined with the antenna of the fifth and sixth embodiments. The radio communication device may be designed in a hearing aid-type worn on a ear, a glasses-type worn on a nose and ears.

What is claimed is:

1. An antenna for a portable radio communication device having a casing comprising:

a first electrode member disposed in the casing as a first antenna element; and a second electrode member provided as a second antenna element to form an electric field-type dipole antenna in pair with the first electrode member, wherein the first electrode member is constructed to be capacitively coupled with a human body thorough the casing so that the human body is used as a part of the first antenna element.

2. The antenna as in claim 1, wherein one of the electrode members is a conductive cover of a battery of the radio communication device.

3. The antenna as in claim 1, wherein the casing is made of an insulating material having a predetermined permittivity.

4. An antenna for a portable radio communication device having a circuit plate of multiple layers in a casing comprising:

a conductive pattern formed on top surfaces and side surfaces of a plurality of the multiple layers to provide one of a loop antenna and a slot antenna three-dimensionally;

a first electrode member disposed in the casing as a first antenna element; and a second electrode member provided as a second antenna element to form an electric field-type dipole antenna in pair with the first electrode member, wherein the first electrode member is constructed to be capacitively coupled with a human body through the casing so that the human body is used as a part of the first antenna element, and wherein the dipole antenna and the one of the loop antenna and the slot antenna are combined to make an antenna directivity more isotropic than any of the dipole antenna, the loop antenna and the slot antenna.

5. An antenna for a portable radio communication device having a casing comprising:

a first electrode member disposed in the casing; and a second electrode member disposed in the casing, wherein the first electrode member and the second electrode member are constructed to be capacitively coupled with different parts of a human body thorough the casing, respectively, to provide a loop antenna via a part of the human body.

6. The antenna as in claim 5, further comprising:

a conductive pattern formed on top surfaces and side surfaces of a plurality of multiple layers of a circuit plate to provide one of a loop antenna and a slot antenna three-dimensionally.

7. A method of transmitting a radio signal from a portable radio communication device having a casing made of a resin material, a transmitter circuit disposed in the casing and a conductive member disposed in the casing, the transmitter circuit being connected to the conductive member, the method comprising the steps of:

attaching the casing to a part of a human body in direct contact therewith so that the conductive member is capacitively coupled with the part of human body through the casing to form an electric field-type antenna; and applying an output signal of the transmitter circuit to the conductive member so that the output signal is transmitted from the electric field-type antenna partly formed by the human body.

8. The method as in claim 7, wherein the conductive member is one of a conductive plate and a conductive cover of a battery which supplies electric power to the transmitter circuit.

9. The method as in claim 7, wherein another conductive member is provided in the casing and connected to the transmitter circuit so that the conductive members are used as two antenna elements of a dipole antenna.

10. A portable radio communication device comprising:

a circuit plate of multiple layers that have respective through holes;

a transmitter provided on the circuit plate; and conductive patterns formed on top surfaces of the multiple layers and connected to each other via the through holes of the multiple layers, thereby forming a magnetic field-type antenna connected to the transmitter.

11. The portable radio communication device as in claim 10, further comprising:

a battery; and a shield plate layered with the circuit plate to form an electric field-type antenna with the battery and a part of a human body.

12. The portable radio communication device as in claim 11, further comprising:

a resin casing having a part which is shaped to be sandwiched between the shield plate and a finger of the human body.

* * * * *